United States Patent [19]

Stewart

[11] Patent Number: 4,710,988

[45] Date of Patent: Dec. 8, 1987

[54] FLUSH TOILET

[75] Inventor: John M. Stewart, Ontario, Canada

[73] Assignee: Sanitation Equipment Limited, Concord, Canada

[21] Appl. No.: 830,805

[22] Filed: Feb. 19, 1986

[51] Int. Cl.[4] ..... E03D 11/10

[52] U.S. Cl. ..... 4/438; 4/434; 4/440; 4/441; 4/442; 4/323

[58] Field of Search ..... 4/323, 321, 317, 438, 4/440, 441, 442, 429, 430, 249, 308, 320

[56] References Cited

U.S. PATENT DOCUMENTS

| | | | |
|---|---|---|---|
| 2,224,868 | 12/1940 | Houck et al. | 4/323 X |
| 2,675,562 | 4/1954 | Duner | 4/440 |
| 3,566,418 | 3/1971 | Carlson et al. | 4/441 |
| 3,570,018 | 3/1971 | Sargent et al. | 4/323 |
| 3,781,920 | 1/1974 | Browne et al. | 4/441 |
| 3,798,681 | 3/1974 | Johansen | 4/440 |
| 3,883,903 | 5/1975 | Broek et al. | 4/440 |
| 3,905,049 | 9/1975 | Stokes et al. | 4/317 X |
| 3,939,501 | 2/1976 | Sargent | 4/317 X |
| 4,032,996 | 7/1977 | Sargent et al. | 4/441 |
| 4,155,129 | 5/1979 | Russell | 4/440 X |
| 4,185,340 | 1/1980 | Sargent et al. | 4/438 X |
| 4,192,027 | 3/1980 | Sargent et al. | 4/438 X |
| 4,246,666 | 1/1981 | Stansbury, Jr. | 4/441 X |
| 4,439,875 | 4/1984 | Stewart et al. | 4/321 |

*Primary Examiner*—Henry K. Artis

*Attorney, Agent, or Firm*—Rogers, Bereskin & Parr

[57] ABSTRACT

A flush toilet primarily for use in recreational homes and vehicles is described. A swing drop valve mechanism is used to open and close the outlet of the toilet bowl efficiently and without abrading the seal between the valve and bowl outlet. A flush water inlet valve is mounted in a compartment at the rear of the toilet for easy access for maintenance and is readily removable from the toilet using a minimum of tools. Flushing of the toilet is initiated by a foot pedal connected to the valve mechanism and water inlet valve by cables.

15 Claims, 14 Drawing Figures

FLUSH TOILET

FIELD OF THE INVENTION

This invention relates generally to toilets and is concerned more particularly with flush toilets; that is toilets having means for delivering a flushing liquid (usually water) into the bowl of the toilet as an aid to removing waste material and rinsing the bowl.

BACKGROUND OF THE INVENTION

Flush toilets for domestic use are generally designed to operate using a relatively large volume of water and because of this are not suitable for use in environments in which large volumes of water and/or high capacity waste disposal systems are not available, for example in recreational vehicles, cottages, etc. Low volume flush toilets have therefore been developed for this type of application. The present invention has been devised primarily (but not exclusively) in connection with a toilet of this type.

Generally, low volume flush toilets are designed to operate using to a low pressure flush water supply such as may typically be found in a cottage or recreational vehicle. Portable toilets having flushing systems have also been devised. Typically, a reservoir for flushing liquid is incorporated in the toilet around the bowl and a manually operable pump is provided for dispensing liquid from the reservoir into the bowl.

In neither type of flush toilet is the volume of flush liquid sufficient to empty to a trap such as is conventionally provided at the bowl outlet of a domestic toilet. Normal practice, therefore, is to provide a plain, usually circular opening at the bottom of the toilet bowl and a mechanical sealing mechanism for closing the outlet.

DESCRIPTION OF THE PRIOR ART

Many different types of sealing mechanisms have been proposed. For example, U. S. Pat. No. 3,570,018 (Sargent et al.) shows a sealing mechanism in the form of a valve member that slides transversely across the bowl opening. A slide valve has the disadvantage that it tends to abrade the seal that is normally provided around the bowl outlet.

U. S. Pat. No. 3,939,501 (Sargent) shows a sealing mechanism including a flexible diaphragm that is tensioned into contact with the bowl outlet so as to seal the outlet. The toilet is flushed by depressing a lever moves the diaphragm to a position in which it uncovers the bowl outlet.

U. S. Pat. No. 4,192,027 (Sargent et al.) shows a yoke-shaped, pivotal valve member for opening and closing the bowl outlet. An actuation member moves relative to the valve member and co-operating cam surfaces on the valve member and actuation member urge the valve member upwardly to seal the bowl outlet.

Yet another proposal is shown in U. S. Pat. No. 4,032,996 (Sargent et al.). In this case, the bowl outlet is closed by a movable blade pivotally supported on an arm of a vertically disposed crank which is spring-actuated to press the blade against the bowl outlet. The crank can be depressed and pivoted to move the blade aside for flushing of the toilet.

U. S. Pats. Nos. 4,091,475 (Hewson et al.) and 4,439,875 (Stewart et al.) disclose examples of a toilet having a sealing mechanism in the form of a valve member that moves generally vertically towards and away from the bowl outlet and then laterally to open the outlet so as to avoid abrasion of the outlet seal.

SUMMARY OF THE INVENTION

One aspect of the invention provides an improved valve arrangement for a flush toilet. The toilet has a bowl with a downwardly opening waste outlet at a lower end thereof, surrounded by an annular sealing surface. A housing supports the bowl above a floor surface and defines an internal space below the bowl outlet for receiving waste from the bowl. The housing has a bottom wall that includes a waste disposal outlet from the said space for connection to external waste disposal means. A valve member is adapted to co-operate with the annular sealing surface surrounding the bowl outlet, for closing the outlet. The valve member is pivotally supported for movement between a closed position in which it co-operates with the sealing surface and closes the bowl outlet, and an open position clear of the bowl outlet and the valve member is constrained to swing downwardly away from the sealing surface while moving laterally towards its open position when the bowl outlet is to be opened. The toilet also includes actuation means accessible from externally of the housing for moving the valve member between its closed and open positions and flush means operable to deliver flushing liquid into the bowl at appropriate times.

Another aspect of the invention provides a flush toilet having a toilet bowl with a downwardly opening waste outlet at a lower end thereof surrounded by an annular sealing surface, means for supporting the bowl above a floor surface and flush means operable to deliver flushing liquid into the bowl at appropriate times and including a water inlet valve for coupling to an external water supply. A valve member is adapted to co-operate with the annular sealing surface surrounding the bowl outlet for closing the outlet and is supported for movement between its closed position and an open position clear of the outlet. The toilet also has actuation means including a foot pedal accessible from externally of the toilet and movable between a normal elevated position to which the pedal is biassed and a depressed operating position. The foot pedal is connected with the valve member for moving the member between its closed and open positions by connecting means including a first cable displaceable in response to depression of the foot pedal to move the valve member from its closed position to its open position. A second cable is connected between the foot pedal and the flush water inlet valve and is arranged to open the valve in response to depression of the pedal. Means is provided effective on release of the foot pedal to return the valve member to its closed position and close the water inlet valve. The foot pedal is arranged, when in its depressed operating position, to abut a floor surface on which the toilet is supported so that depression beyond said position and hence overstraining of the components actuated by the actuation means is positively prevented.

A further aspect of the invention provides an improvement in the flush means of a toilet of the type in which the bowl outlet is closed by a valve member pivotally supported for movement between a closed position in which the member co-operates with a sealing surface around the bowl outlet and closes the outlet and an open position clear of the bowl outlet. The flush means is operable to deliver flushing water into the bowl at appropriate times and includes a water inlet valve having an inlet for coupling to an external water supply and an outer, nozzle means in an upper region of the bowl through which flush water is delivered to the bowl, a pipe extending around an upper portion of the toilet bowl at least substantially above the level of the nozzle means, said pipe connecting the nozzle means with the outlet of the flush water inlet valve and defining a reservoir for retaining a body of flush water after closure of said inlet valve. The inlet valve includes vacuum breaker means arranged to open in response to closure of the valve and admit air to the reservoir, permitting water in the reservoir to drain through the nozzle. Actuation means is provided and is accessible from externally of the housing for operating the water inlet valve and moving the valve member between its closed and open positions. The actuation means is arranged so that the valve member is closed during draining of the reservoir to permit refilling of the bowl from the reservoir with a residual amount of flush water.

In a still further aspect of the invention, a flush water inlet valve of a flush toilet is readily removable from externally of the toilet. The toilet has a bowl supported by a housing as defined above, and a valve member adapted to co-operate with an annular sealing surface surrounding the bowl outlet for closing the outlet. The valve member is supported for movement between a closed position in which the valve member co-operates with the said sealing surface and closes the bowl outlet, and an open position clear of the bowl outlet. Actuation means accessible from externally of the housing is provided for moving the valve member between its closed and open positions. The flush water inlet valve is disposed on the upper housing part rearwardly of the toilet bowl and is accessible from externally of the toilet. The valve includes a valve body disposed on a support surface of the upper housing part and having an internally screw-threaded water inlet passageway opening into a lower face of the body. A generally tubular coupling member extends upwardly through an opening in the said surface and is threaded at an upper end portion thereof into the water inlet passageway of the valve body. The coupling member has a lower end portion adapted to be coupled to a water supply and an external rib intermediate said end portions arranged to co-operate with the housing around said opening as the coupling member is screwed into said passageway on the valve body to clamp the body against the support surface. The housing is shaped to provide access to the coupling member below the valve body so that the valve can be released from the toilet by unscrewing the coupling member.

BRIEF DESCRIPTION OF THE DRAWINGS

In order that the invention may be more clearly understood, reference will now be made to the accompanying drawings which illustrate a preferred embodiment of the invention by way of example, and in which.

DESCRIPTION OF THE PREFERRED EMBODIMENTS

Figure 1:
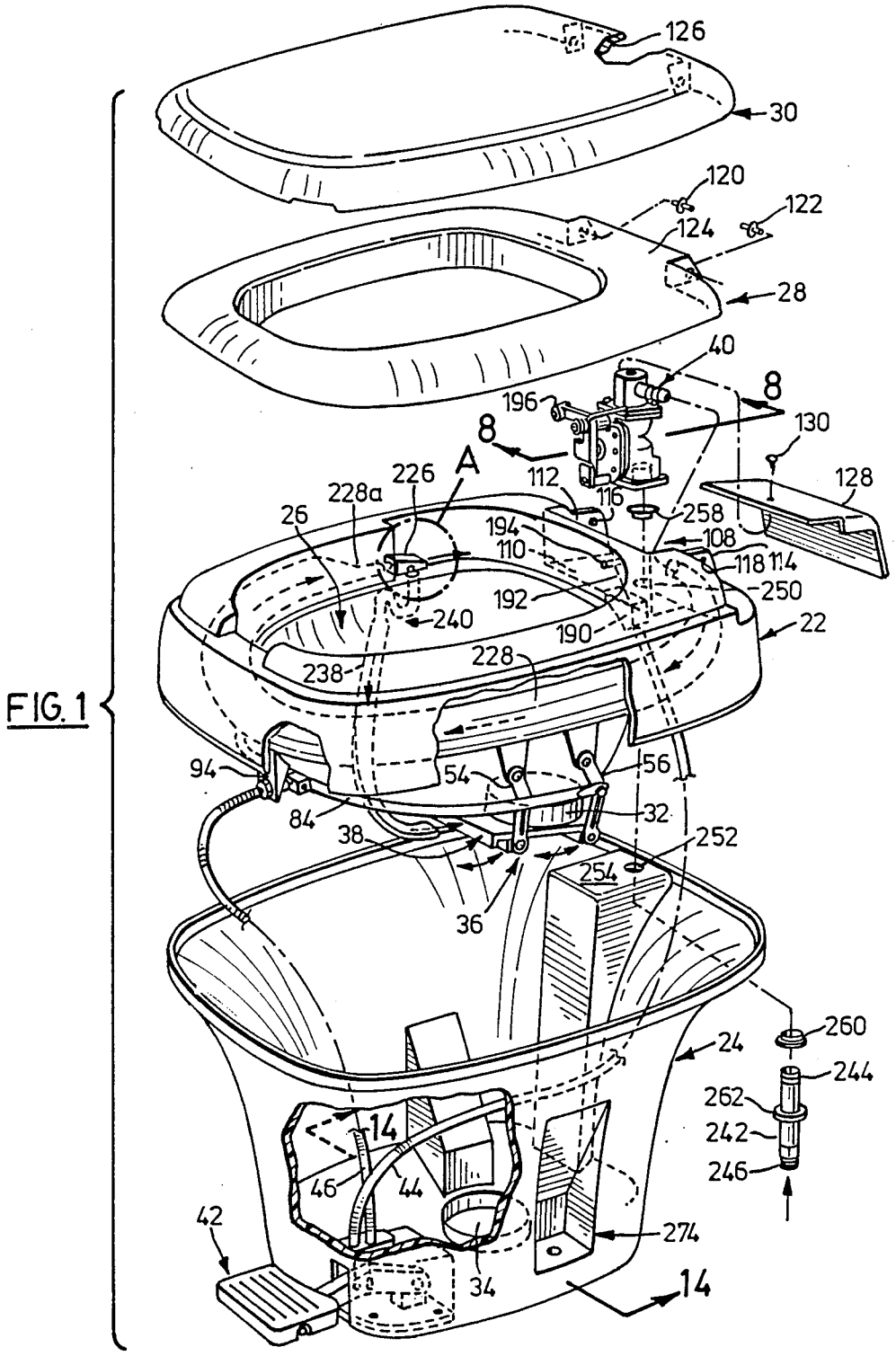
FIG. 1 is an exploded perspective view of a flush toilet in accordance with the invention.

Referring first to FIG. 1 a flush toilet is shown to include a housing 20 made up of an upper housing part 22 and a lower housing part 24. Each of the two housing parts is a one-piece plastic moulding. The upper housing part 22 incorporates a toilet bowl 26 and is designed to fit onto the lower housing part 24 so that the toilet bowl is supported above a floor surface on which the toilet is disposed. A seat and lid, denoted 28 and 30 respectively are designed to pivotally coupled to the upper housing part 22 generally in conventional fashion so that the toilet, with the seat and lid in closed positions has the general appearance shown in FIG. 12, when viewed from the rear.

Figure 14:
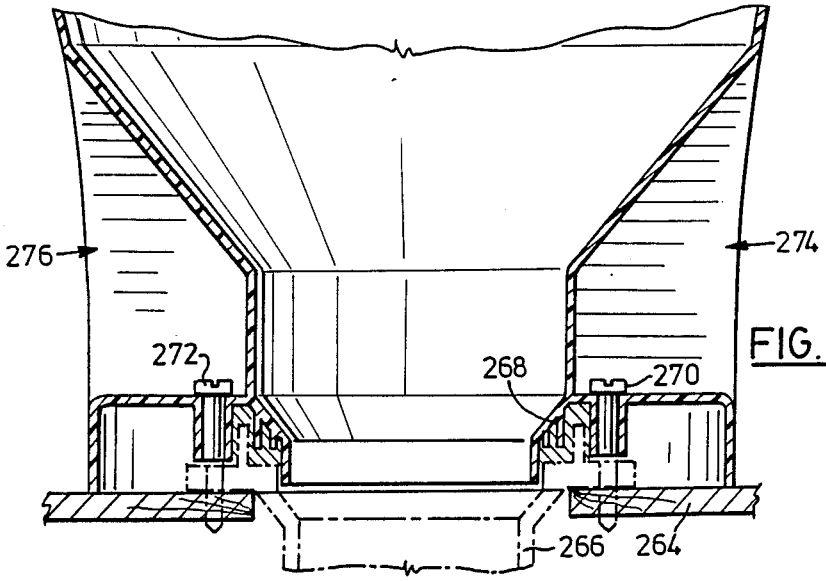
FIG. 14 is a detail vertical sectional view on line 14—14 of FIG. 1, illustrating installation of the toilet to a standard floor flange of a sewage disposal system.

Toilet bowl 26 has a downwardly opening waste outlet 32 at a lower end thereof. When the housing is assembled, the two housing parts 22, 24 together define an internal space below the bowl outlet 32 for receiving waste from the bowl. That space itself has a waste disposal outlet 34 in a bottom wall 24*a* of housing part 24, for connection to external waste disposal means such as a vertical downpipe of a conventional sewage system, for example as shown in FIG. 14 (to be described).

A valve mechanism for closing the bowl outlet 32 is generally designated by reference numeral 36 in FIG. 1 and includes a valve member or clapper 38 which is pivotally suspended from the upper housing part 22 for movement between the closed position in which it is shown in FIG. 1 and an open position clear of outlet 32. The valve mechanism and its operation will be described in more detail later.

The toilet is designed to be flushed using water from an external water supply that is connected to a water inlet valve 40 supported on the upper housing part 22 rearwardly of the toilet bowl.

FIG. 1 also shows a foot pedal 42 for flushing the toilet. The foot pedal is connected by cables 44 and 46 respectively to the water inlet valve 40 and valve mechanism 36 so that depression of the foot pedal will operate both the water inlet valve 40 and the valve mechanism 36 to flush the toilet, as will be more specifically described later.

Figure 2:
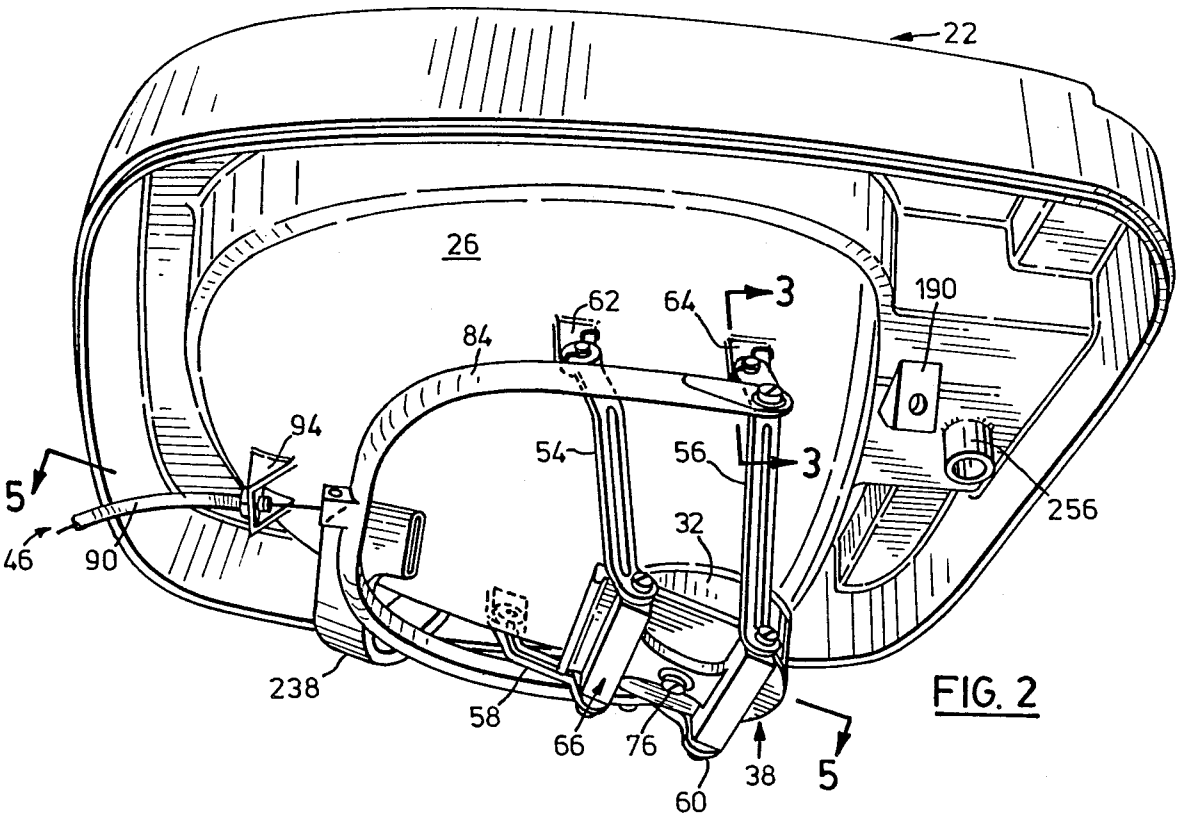
FIG. 2 is an underneath perspective view of an upper part of the toilet housing including the toilet bowl.
Figure 3:
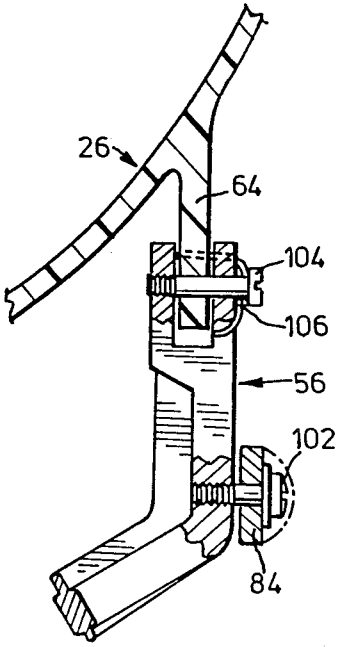
FIG. 3 is a sectional view on line 3—3 of FIG. 2.
Figure 4:
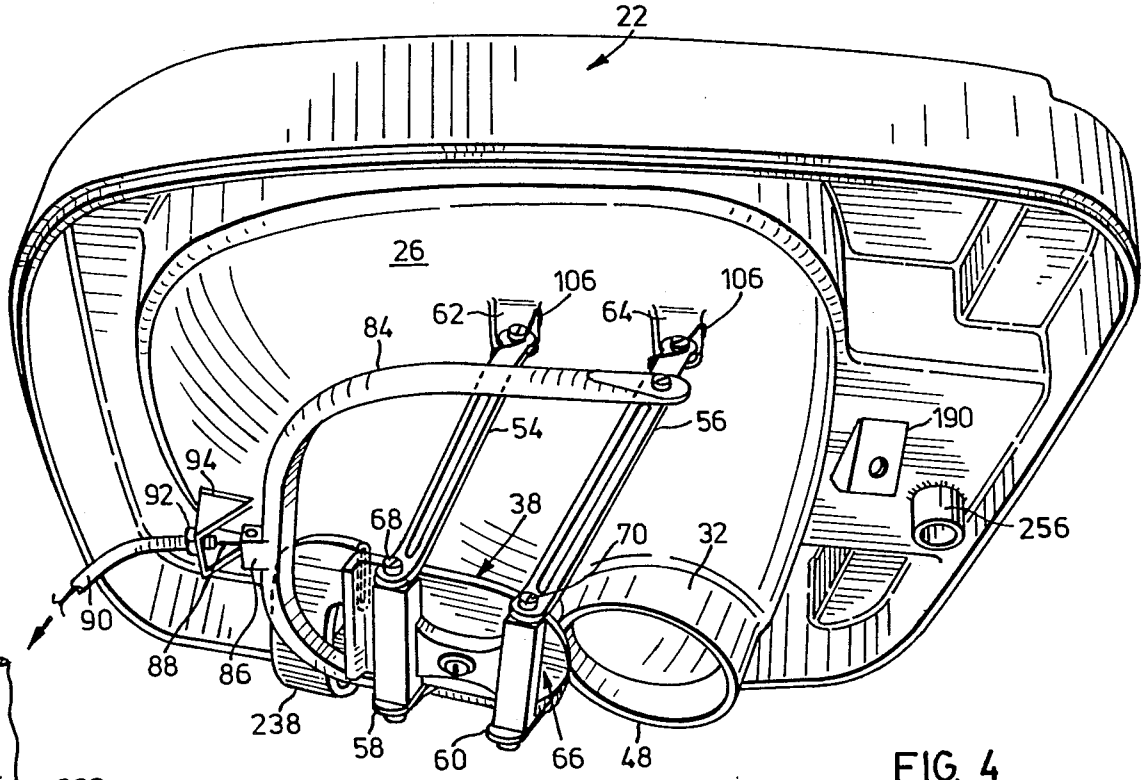
FIG. 4 is a view similar to FIG. 2 but showing the valve member of the toilet in an open position.
Figure 5:
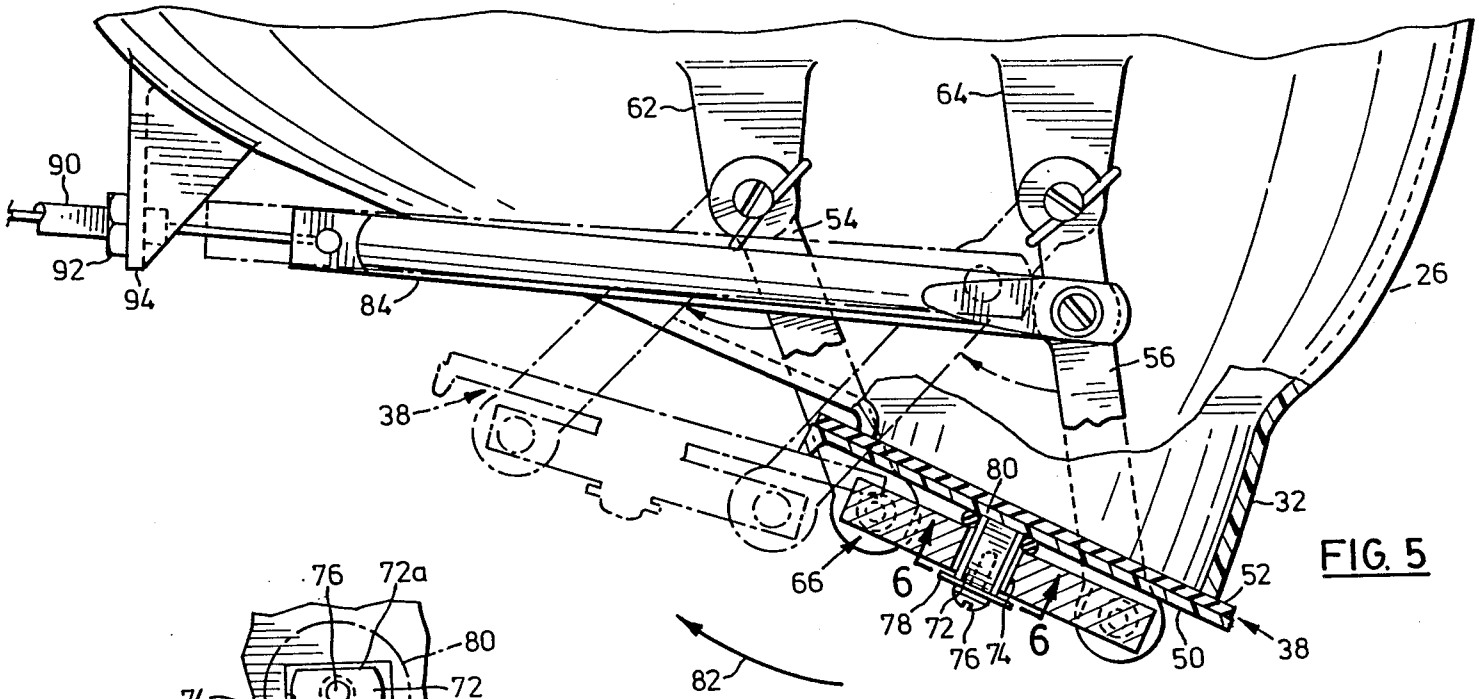
FIG. 5 is a vertical sectional view on line 5—5 of FIG. 2 showing the valve member in both open and closed positions.

Reference will now be made to FIGS. 2 to 6 in describing valve mechanism 36 in more detail. FIGS. 2 and 4 show the upper housing part 22 in perspective as seen from below with the valve member 38 respectively in the closed and open positions. As seen in FIG. 4, an annular sealing surface 48 is visible around outlet 32. In the closed position of the valve member as shown in FIGS. 2 and 5 the valve member co-operates with this sealing surface to close the toilet bowl outlet. As best shown in FIG. 5, valve member 38 takes the form of a plate 50 having a flat upper surface covered with a layer 52 of rubber that forms a seal with the sealing surface 48 around bowl outlet 32 when the valve member is in its closed position.

The valve member is pivotally coupled to the upper housing part 22 by four pivoted links arranged in pairs at opposite sides of the valve member. Two of those links are denoted 54 and 56 in FIGS. 2, 4 and 5 and the links at the other side of the valve member are essentially the same. Parts of those links are visible at 58 and 60 in FIGS. 2 and 4. At their upper ends, the links are pivotally coupled to brackets or lugs integrally moulded on the upper housing part 22. Two of those lugs are visible at 62 and 64 in FIG. 4; similar lugs are provided at the opposite side of the toilet bowl. At their lower ends, the links are pivotally coupled to the ends of the limbs of a generally H-shaped carrier member 66 that supports the valve member 38. This is achieved by bolts, such as those indicated at 68 and 70 in FIGS. 2 and 4, each of which extends through a plain opening in the end portion of the relevant link and is bonded into the carrier member 68 so as to allow the link to turn freely with respect to the carrier member.

Figure 6:
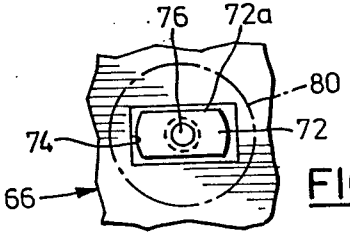
FIG. 6 is a sectional view on line 6—6 of FIG. 5.

As best seen in FIG. 5, a moulded plastic stem or boss 72 projects outwardly from the valve plate 50 through a slot 74 generally at the centre of the carrier member 66. A bolt 76 with a washer 78 under its head is bonded into boss 72 so that the carrier member 66 and plate 50 are relatively loosely coupled together while permitting limited relative tipping movement therebetween. An "O" ring 80 is provided around boss 72 between the carrier member 66 and the valve plate and serves to resiliently limit relative movement between the carrier member and the valve plate. This coupling arrangement allows the valve member to tip slightly with respect to the carrier member to ensure that the valve member makes contact with the bowl outlet sealing surface 48 (FIG. 4) around its entire perimeter. As shown in FIG. 6, boss 72 has flats 72*a* and is dimensioned to fit, relatively closely within slot 74 so as to prevent the valve member turning and thereby maintain correct alingment of the valve member with the bowl outlet.

FIG. 5 shows the valve member in full lines in its closed position over the bowl outlet, and in ghost outline in an open position clear of the bowl outlet. That view also illustrates the fact that the links by which the valve member is suspended (such as the links 54 and 56) are of unequal length. The lengths of those links and their pivot points are selected to cause the valve member to swing downwardly away from the sealing surface 48 around the bowl outlet while moving laterally towards the open position when the valve member is opened, generally as indicated by the arrow denoted 82 in FIG. 5.

As best seen in FIGS. 2 and 4, a generally U-shaped yoke 84 is pivotally coupled at its ends to the two valve member suspension links closest to the rear of the toilet; that is, the link 56 and the corresponding link at the opposite side of the toilet. The yoke extends forwardly around but clear of the other two links in a generally horizontal plane and is provided at its forwardmost end with a boss or enlargement 86 to which is connected the actuating cable 46 connected to foot pedal 42 (see FIG. 1). Cable 46 (as well as cable 44) is a conventional Bowden cable comprising an inner wire 88 capable of free longitudinal sliding movement in an outer casing 90. Outer end portions of casing 90 are externally screw-threaded and each portion is provided with a nut, one of which is shown at 92 in FIG. 4. The portion of casing 90 outwardly of nut 92 extends through a bracket 94 that is integrally moulded as part of the upper housing part 22 and disposed externally on the toilet bowl. At its outer end, the inner wire 88 of cable 46 is provided with an enlargement 96 that is received in an opening in the boss 86 on yoke 84.

Figure 11:
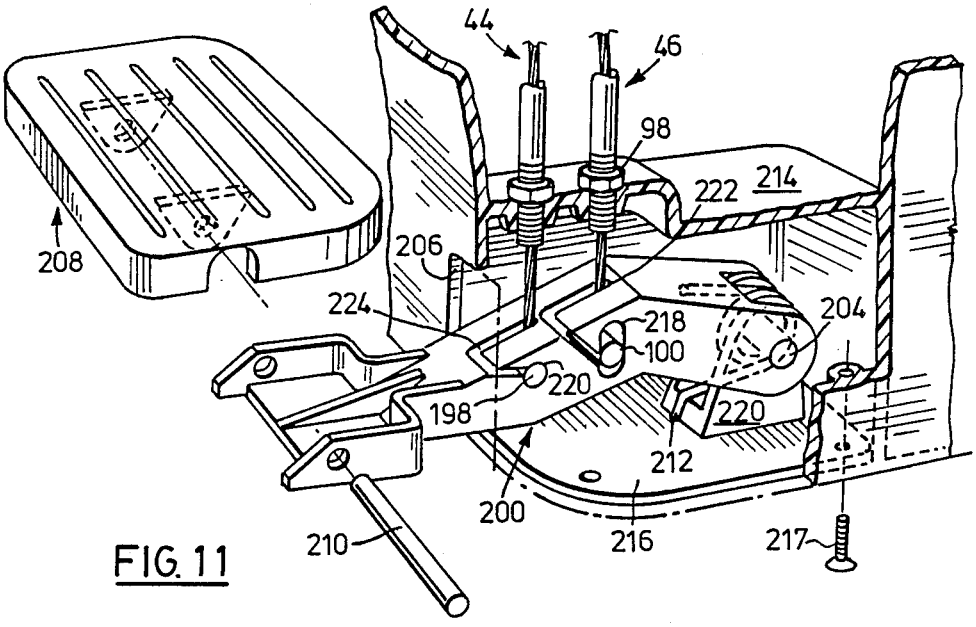
FIG. 11 is a detail perspective view, partly in section and partly exploded, showing a foot pedal actuator of the toilet.

FIG. 1 shows the route of cable 46 from bracket 94 to the foot pedal while FIG. 11 shows the attachment of both cable 46 and cable 44 to the foot pedal. Details of the attachment will be described later. For present purposes, it is sufficient to note that cable 46 is essentially the same at the foot pedal end and as at the yoke end and includes a nut 98 on the outer casing 90 and an enlargement 100 on the inner wire 88. In that case, nut 98 abuts against a portion of the lower housing part 24 that forms an enclosure for the foot pedal.

It will be appreciated that depression of foot pedal 42 will cause wire 88 to be drawn through casing 90 pulling yoke 84 towards the front of the toilet. Starting from the "valve closed" position of FIG. 2 the effect of this will of course be to cause the valve member 38 to swing downwardly away from the toilet bowl outlet and forwardly to the open position in which it appears in FIG. 4.

FIG. 3 shows details of the connection between the yoke 84 to the valve member suspension link 56 as well as the pivotal connection of the link itself to its suspension bracket 64. It will be seen that the yoke is connected to the arm by a bolt 102 that extends through a clearance opening in the yoke and is bonded into a screw-threaded opening in the arm. The opposite end of the yoke is connected to the corresponding link at the other side in the same fashion. The pivotal coupling between the upper end of link 56 and the associated bracket 64 is typical of the pivotal coupling of all four links. As can be seen, the upper end portion of the link is bifurcated to form two spaced portions 56*a* between which bracket 64 is received. A bolt 104 then extends through both bifurcated portions and through a clearance hole in the bracket and the bolt is bonded in place. A spiral spring 106 behind the head of bolt 104 has outer end portions that are hooked around bracket 64 and arm 56 and the spring is arranged to bias the link in the counterclockwise direction as seen in FIGS. 2 and 4 so as to tend to return the valve member 38 to its closed position. Similar return springs are provided at the pivot points of the other three suspension links for the valve member. The return springs are of sufficient strength to positively return the valve mechanism to the closed position when foot pedal 42 is released.

As noted previously, the toilet is designed to be flushed using water from an external supply that is delivered to the toilet through a water valve 40 (FIG. 1) controlled by foot pedal 42. In the assembled toilet, water valve 40 is housed within a compartment formed in the upper housing part 22 of the toilet rearwardly of the bowl 26. In FIG. 1, the compartment is generally indicated by reference numeral 108 and has a flat bottom wall 110 forming a supporting surface for the valve and side walls 112 and 114; these side walls are extended outwardly to form lugs providing pivot points for the toilet seat 28 and lid 30. Thus, the lugs have respective openings 116 and 118 that receive pivot pins shown in exploded positions 120 and 122 for engagement in corresponding openings in both the seat and lid. Seat 28 has a rearward extension 124 at its hollow end dimensioned to fit over the protruding lugs 112 and 114 while lid 30 has a corresponding recess 126 dimensioned to receive the extension 124 on the seat. The lid also has a downwardly curved skirt that fits over the seat so that the seat is substantially closed by the lid when the lid is closed.

Figure 13:
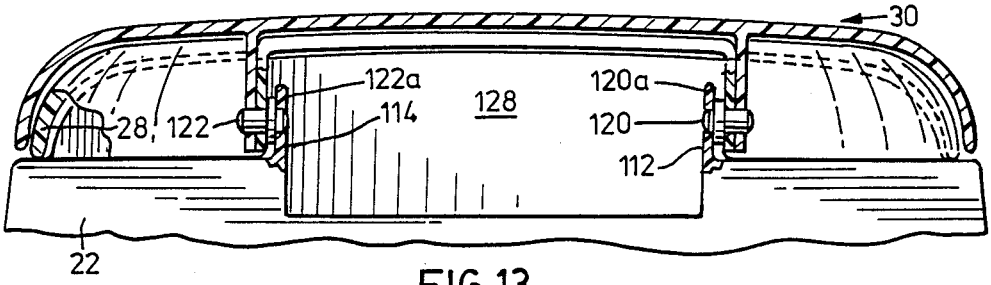
FIG. 13 is a sectional view on line 13—13 of FIG. 12.

FIG. 13 shows details of the pivotal connection between the seat, lid and upper housing part. It will be seen that the two pivot pins 120, 122 extend outwardly from the respective lugs 112, 114 and through corresponding openings, first in the seat extension 124 and then in the walls of the recess 126 in lid 30. Peripheral ribs **120*a* and 122*a* respectively on the pins are located outwardly of the respective lugs 112, 114** for assuring smooth pivoting of the lid and seat.

Figure 12:
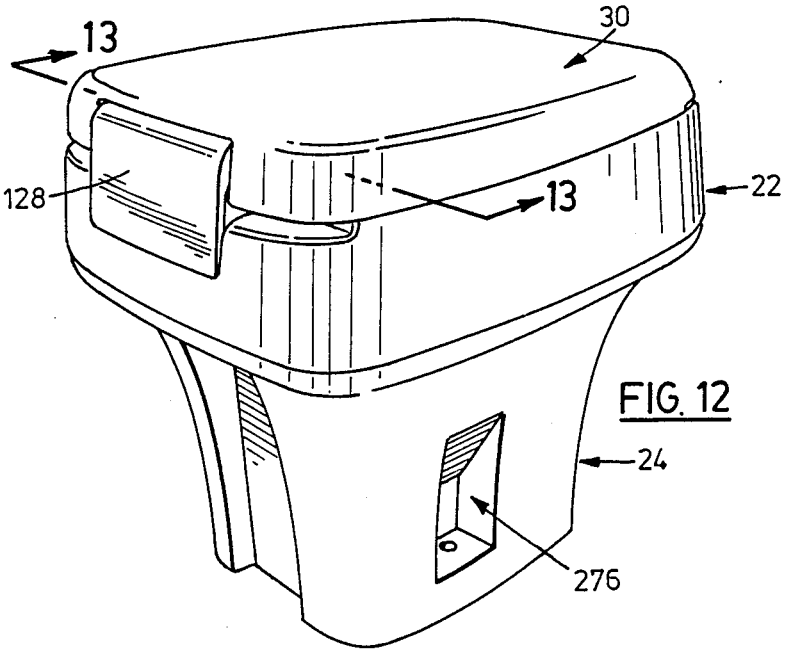
FIG. 12 is a rear perspective view of the assembled toilet.

FIG. 12 shows the toilet as seen from the rear with the seat and lid closed. Reference numeral 128 denotes a removable cover plate for the water inlet valve 40. Cover plate 128 is also visible in FIG. 1 and in effect forms a closure for the compartment 108 in which the water valve is located. The cover plate is held in place by a screw 130 that is threaded into the valve itself. It will be appreciated that this location for the valve permits ready access to the valve for maintenance purposes simply by removing screw 130 and cover plate 128. The valve itself is also readily removable from the toilet as will be described later.

Figure 8:
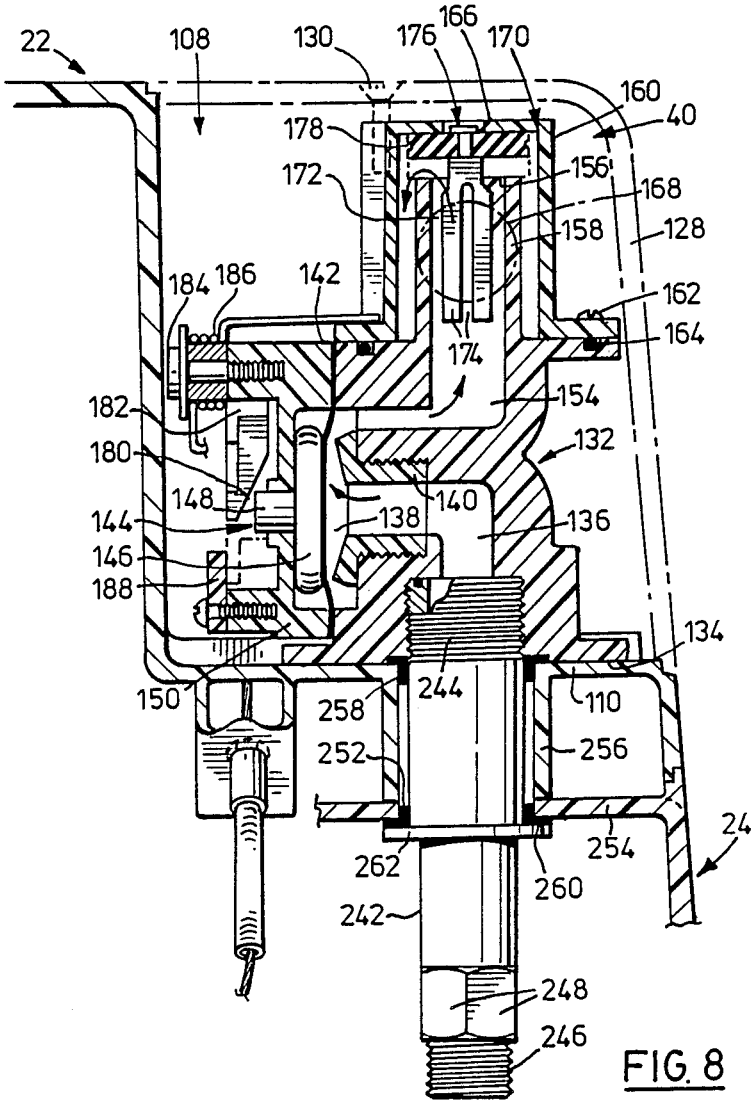
FIG. 8 is a partial vertical sectional view on line 8—8 of FIG. 1 with the toilet assembled.

FIG. 8 is a vertical sectional view showing the water valve installed in the compartment 108 on the upper toilet part 22. Valve 40 has a body 132 with a flat base 134 supported on the bottom wall 110 of compartment 108. A water inlet passageway 136 extends upwardly through body 132 from base 134 and then forwardly to a valve chamber 138. A replaceable valve seat 140 is screw threaded into the forward end of passageway 136.

The fact that valve seat 140 is replaceable is important not only because it allows the valve seat to be changed if it should become damaged, for example due to debris in the flush water (such as may often occur in rural environments), but also because valve seats with differently sized internal passageways can then be used to compensate for varying water pressure in different locations.

Figure 9:
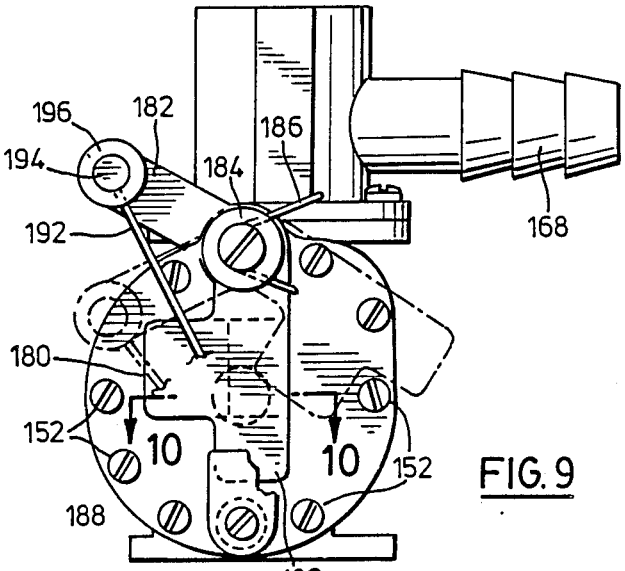
FIG. 9 is a front elevational view of the flush valve of the toilet.

Valve 40 is a diaphragm valve and includes a diaphragm 142 that extends across valve chamber 138 for movement towards and away from the valve seat 140 to close and open respectively water inlet passageway 136. At the opposite side of diaphragm 142 from valve seat 140 is a generally mushroom-shaped actuating member 144 having a head 146 that bears against the diaphragm, and a stem 148 that extends outwardly from the head and is a sliding fit in an opening in a cover plate 150 for the valve body. Diaphragm 142 is trapped between this cover plate and the valve body and the cover plate is held to the valve body by screws 152 as shown in FIG. 9.

With continued reference to FIG. 8, a water outlet passageway 154 extends rearwardly of the top of valve chamber 138 as it appears in that view and then upwardly to an outlet 156 at the top of an outlet sleeve 158 formed as part of the valve body. Surrounding sleeve 158 and spaced outwardly therefrom is a cap 160 that is secured to the valve body by screws 162 with the interposition of a seal 164. Cap 160 has a vent opening 166 in its top wall. A main water outlet spigot 168 extends laterally from cap 160 at the far side of the cap as it is shown in FIG. 8. FIG. 9 shows the valve 40 as seen from the front and spigot 168 can be seen extending laterally from the cap in that view.

Received for free vertical sliding movement in sleeve 158 is a check valve 170 which is shown in the open position in FIG. 8. Valve 170 has a body 172 including four "fins" 174 disposed generally mutually at right angles (only three of which are visible) and serving to locate the valve in sleeve 158. Above the fins, the body includes a headed spigot 176 that extends through a disc-shaped seal 178.

When valve 40 is open as shown in FIG. 8, diaphragm 142 is pressed back clear of the valve seat 140 by the pressure of the water entering through passageway 136 and into the valve chamber. The water then flows upwardly into passageway 140 and lifts the check valve 170 to the position in which it is shown. Seal 178 is lifted from outlet 156 and pressed against the top inside surface of cap 160, sealing opening 166. As can be seen, the spigot 176 moves into opening 166 at this time. When diaphragm 142 is moved into contact with the valve seat 140 by the actuating member 144 water can no longer flow through valve chamber 138 and the check valve 170 will drop under gravity and close the outlet 156 in sleeve 158. Excess water will tend to flow out through the outlet spigot 168 to permit the check valve to close fully. In this position, the check valves acts to back flow of water that might otherwise contaminate the supply, for example in the event of a malfunction or blockage of the toilet.

Check valve 170 also acts as a vacuum breaker in that movement of the valve to its closed position permits air to enter through opening 166 in the cap 160 on the valve body to permit complete drainage of water from areas downstream of the check valve (see later).

Figure 10:
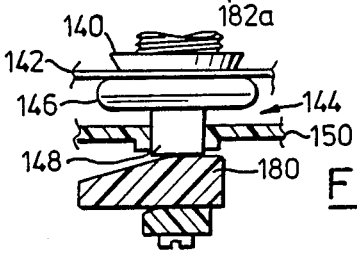
FIG. 10 is a partial sectional view on line 10—10 of FIG. 9.

Actuation of diaphragm 142 under the control of valve member 144 is effected by a cam 180 carried by an operating lever 182 pivotally coupled to the valve body by a pivot screw 184. The shape of lever 182 is best seen in FIG. 9, in which the lever is shown in full lines in the "valve closed" position and in ghost outline in the "valve open" position. Thus, the ghost outline position of FIG. 9 corresponds to the full line position of FIG. 8. FIG. 10 illustrates how the cam 180 carried by lever 182 presses the valve actuating member 144 forwardly by acting on its stem 148 to press the diaphragm 142 into contact with the valve seat member 140.

A return spring 186 on the pivot screw 184 for lever 182 normally maintains lever 182 in the full line "valve closed" position of FIG. 9. A keeper 188 located on one of the screws 152 that hold the cover plate 150 to the valve body 132 captures an outer end portion **182*a* of lever 182** in the valve closed position to guard against any possible flexing of the lever that might permit partial opening of the valve.

As discussed previously, the water inlet valve 40 is cable actuated from the foot pedal 42 of the toilet. The actuating cable is denoted 44 in FIG. 1 and is a Bowden cable essentially the same as cable 46. Referring to FIG. 1, the outer casing of casing of cable 44 extends upwardly from the foot pedal to a moulded plastic bracket 190 in the upper part of the toilet housing where the relevant end of the casing is retained in essentially the same way as the outer casing of cable 46 as discussed previously in connection with FIGS. 2 and 4. The inner wire 192 of cable 44 extends through bracket 190 and has at its outer end a generally cylindrical fitment 194 again similar to the fitment 96 at the upper end of cable 46. This fitment is received in a cylindrical sleeve 196 at the outer end of the valve operating level 182. Thus, when the foot pedal 42 is depressed, causing the inner wire 192 of cable 44 to be drawn downwardly, the valve operating lever will be pivoted in the counterclockwise direction as seen in FIGS. 1 and 9, moving cam 180 clear of the stem 146 of the valve diaphragm actuating member 144 so that water pressure in the water valve inlet passageway 136 (FIG. 8) will force the diaphragm 142 away from the valve seat 140 and allow water to flow through the valve. When the foot pedal is released, return spring 186 will bring the operating lever 182 back to the "valve closed" position in which it appears in FIG. 9.

At the foot pedal end (FIG. 11), the inner wire 192 of cable 44 is connected to the foot pedal itself while its outer casing is retained on a part of the foot pedal housing, generally as described above for cable 46. The foot pedal itself comprises a lever 200 pivotally coupled at an inner end inside the lower housing part 24 to a fixed bracket 202 by way of a pivot pin 204. The lever extends through an opening 206 in housing part 24 and has a bifurcated outer end portion to which a tread pad 208 is coupled by a pivot pin 210. A coil spring 212 on the lever pivot pin 204 biasses the lever upwardly at its outer end so that the normal rest position of the foot pedal is with tread pad 208 raised.

A housing 214 for the foot pedal is integrally moulded into the lower housing part 24 inwardly of the pedal lever opening 206. The lever mounting bracket 202 is carried by a separate base plate 216 that is assembled to the housing part 24 by a series of screws, one of which is shown at 217, received in corresponding bosses moulded into the outer wall of the housing part 24. Thus, the foot pedal mechanism is entirely isolated from the waste-receiving space within the lower housing part 24.

As noted previously, the fitments 100 and 198 at the lower ends of the two cables 46 and 44 respectively are received in openings in the foot pedal lever. In FIG. 11, these openings are denoted respectively 218 and 220 and have associated angled access slots 222 and 224 for accommodating the inner wires of the respective cables when the end fitments 100 and 198 are being inserted into or removed from their respective openings. It will also be noted that cable fitment 198 is a snug fit within its opening 220 while the corresponding opening 218 for fitment 100 is vertically elongated somewhat to allow for a limited degree of free vertical movement of the foot pedal with respect to the fitment. As a result, when foot pedal 42 is depressed from its normal raised rest position, cable 44 will be immediately actuated initially without actuating cable 46. This means that the water inlet valve will open before the toilet bowl outlet is opened so that flush water will be delivered to the toilet bowl. Continued downward movement of the foot pedal will then bring along the inner wire of cable 46 after its fitment 100 has reached the top of opening 218. The toilet bowl outlet will then be open to allow the contents of the bowl to leave. When the foot pedal is subsequently released the bowl outlet valve 36 will close first as the foot pedal approaches its raised rest position but the water inlet valve 40 will remain open slightly longer for providing a final bowl rinse. In addition, the flush system of the toilet is designed to provide for refilling of the bowl with a residual amount of flush water as will shortly be described.

An important practical feature of the foot pedal 42 is that it is designed to "bottom out" on the floor surface on which the toilet is installed. In other words, the floor acts as a stop for preventing further depression of the foot pedal beyond the position in which both the water inlet valve 40 and the toilet bowl valve mechanism 36 are fully open. This prevents possible overstraining of the components actuated by the foot pedal such as might occur if the foot pedal could be depressed beyond the "fully on" positions of the water inlet valve and toilet bowl closure valve member.

Referring back to FIG. 1, it will be recalled that the water valve outlet spigot 168 delivers flush water when valve 40 is open. That spigot is connected to a flush water dispensing nozzle 226 located at the rim of the toilet bowl, by a relatively large diameter tube 228 that forms a reservoir for a volume of flush water sufficient to provide the required bowl refill. Tube 228 is pushed on to spigot 168 at the water valve end and then extends around a substantial portion of the perimeter of the bowl within the upper toilet housing part 22, to nozzle 226. Tube 228 is moulded in a suitable plastic material to the shape shown and has a rounded rectangular cross-section and an end portion that tapers down to a relatively narrow outer end part **228*a* and frictionally fits over an inlet spigot on nozzle 226. The volume of water used to refill the bowl is selected by moulding tube 228** in an appropriate size.

Figure 7:
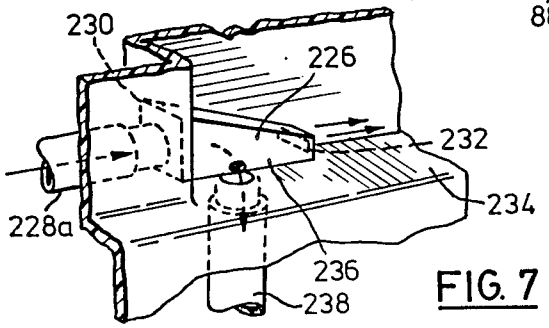
FIG. 7 is a detail view of the part of FIG. 1 indicated by the circle denoted A.

FIG. 7 is an enlarged view of the nozzle area indicated by the circle denoted A in FIG. 1. It will be seen that the nozzle itself is generally wedge shaped with a cylindrical spigot 230 fitted within the outer end portion 228 of the reservoir pipe. Nozzle 226 has a main flush water opening 232 at its narrow end that is directed generally laterally onto a ledge 234 forming the upper rim of the toilet bowl. By directing the watering this way, a swirling motion is achieved within the bowl for good bowl rinsing.

Nozzle 226 also has a secondary water outlet 236 in its bottom face through which a minor portion of flushing liquid is directed into a further pipe 238 for rinsing of the bowl outlet valve member when in its open position. Pipe 238 also acts as a bowl overflow should the bowl outlet become blocked.

Pipe 238 is shown in FIG. 1. The pipe is moulded in a plastic material to incorporate a trap 240 just below nozzle 226. The pipe is then shaped to extend downwardly alongside the bowl and then curve laterally inwardly and finally laterally rearwardly to a position just in advance of the open position of the valve member 38, as best seen in FIGS. 2 and 4. It can be seen particularly that the pipe 38 has a relatively flat cross-sectional shape. This shape has been adopted in order to permit the pipe to be accommodated within the relatively confined space available. A suitable clip (not shown) may be moulded onto the exterior of the toilet bowl to retain the outer ends of the pipe. As best seen in FIG. 4 the outlet end of the pipe is positioned to deliver a minor portion of the flush liquid over the exposed top face of the valve member 38 for flushing that face.

Referring back to FIG. 1, when the water inlet valve 40 is opened to flush the toilet, water will be delivered from the outlet spigot 168 through tube 228 to nozzle 226. Most of the flushing water will flow through the outlet 232 of the nozzle but a minor portion will be delivered downwardly through pipe 238 to flush the valve member 38 (which will be in its open position at this time). At the instant when the water inlet valve 40 closes the tube 228 supplying flush nozzle 226 will be full of water. Referring back to FIG. 8, the check valve 170 will at this time fall under gravity to its closed position, so that air can enter through opening 166. Opening 166 communicates with the outlet spigot 168 and hence with tube 228 by way of the interior space within cap 160 so that entry of air through opening 166 will allow the water within tube 228 to drain through nozzle 226 for refilling the bowl with a residual amount of water (valve member 38 will of course be closed at this time). A minor portion of the residual water within tube 228 will be lost through the valve member rinse pipe 238 but this will be neglible.

Referring again to FIG. 8, a further feature of the water inlet valve 40 is that it is not only easily accessible at the rear of the toilet for in situ maintenance as discussed previously but also that it can be readily removed from the toilet (e.g. for replacement or extensive maintenance) without removing the toilet from its installed position and using few tools. This is achieved by securing the valve body in position within compartment 108 by means of a tubular water supply coupling member 242 that in effect clamps the valve body to its support surface 110.

Coupling member 242 has an externally screw-threaded upper portion 244 that is received in a correspondingly internally screw-threaded portion of the water inlet passageway 136, and an externally screw-threaded lower portion 246 for connection to an external water supply pipe. A series of flats 248 are provided above the threaded portion 246 for permitting turning of the coupling member by a wrench.

Referring back to FIG. 1, an opening through the bottom wall 110 of compartment 108 for receiving the coupling member 242 is shown at 250 and is aligned with a similar opening 252 in the lower housing part 24. Opening 252 extends through the top wall 254 of a recess that extends vertically over the entire height of housing part 24. Referring to FIG. 8, a sleeve 256 (also visible in FIGS. 2 and 4) extends downwardly from wall 110 and is arranged to seat on the top wall 254 of the recess in the lower housing part 24 when the two housing parts are installed together. Coupling member 242, when installed, extends downwardly from the valve body 132 through opening 250, sleeve 256 and opening 252. Seals 258 and 260 (also shown in FIG. 1) are provided in the openings 250 and 252 respectively. An external rib 262 on coupling member 242 bears against the underside of wall 254 and effectively clamps the valve body against wall 254 with the interposition of sleeve 256 and wall 110. Since the lower portion of the coupling member 242 is accessible within the recess in the lower housing part the valve body can simply be released by reaching into that recess and unscrewing the coupling member, if necessary with the help of a wrench. The valve will then effectively be free to be removed after disconnecting tube 228 from the valve outlet spigot 168 and cable 44. Conversely, the valve can be readily installed in reverse fashion.

FIG. 8 also illustrates the cross-sectional shape of the joint between the upper and lower housing parts 22, 24 of the toilet. These parts will be permanently secured together using an appropriate adhesive.

Installation of the toilet to the floor flange of a conventional sewage disposal system is accomplished in essentially conventional fashion. FIG. 14 shows the lower portion of the housing part 24 of the toilet so installed. The floor itself is denoted by reference numeral 264 and the floor flange of the sewage disposal system is shown in ghost outline at 266 extending upwardly through an opening in the floor in conventional fashion. The lower housing part of the toilet is designed to fit over the floor flange 266 with the interposition of a conventional wax or rubber gasket 268 and to permit the toilet to be bolted to the floor flange by bolts 270, 272 at opposite sides, again in conventional fashion. Recesses 274, 276 are moulded into each side of the lower housing part to provide access to these bolts; the recesses are also shown in FIG. 1 and one of the recesses appears in FIG. 12.

In summary, the toilet provided by the invention offers numerous advantageous features. The valve member for sealing the toilet bowl outlet executes what might be termed a "swing drop" motion in moving between its closed and open positions which avoids damage to the seal between the valve member and the outlet while at the same time achieving efficient sealing in the closed position of the valve member. Cable actuation of the valve member and flush water valve avoid linkages that can wear and corrode and at the same time allows flexible connection between the foot pedal and those parts. The bowl outlet valve and flush valve are foot pedal acuated and are automatically returned to their closed positions by return springs when the foot pedal is released. The foot pedal itself is designed to "bottom out" on a floor surface, avoiding stress in the components of the toilet. This represents a significant advantage as compared with prior art foot pedal actuated toilets in which the depressed position of the foot pedal is generally defined by the resistance of the components to which the foot pedal is coupled. This brings with it the risk of overstraining of those components if excessive pressure is applied to the foot pedal.

The flush system offers the advantage of efficient rinse down and bowl refill while the water inlet valve itself is readily replaceable using a minimum of tools without removal of the toilet. The valve is designed to be taken apart easily for replacement of components and has a replaceable valve seat. This contrasts with prior art arrangements in which servicing of the water valve requires removal of the toilet. Not only is this inconvenient but it leads to damage of the seal between the waste outlet of the toilet and the sewage system inlet and means that the seal must be replaced.

It will of course be appreciated that the preceding description relates to a particular preferred embodiment of the invention and that many modifications are possible within the broad scope of the claims. For example, various features of the toilet could be used individually without other features. The swing drop valve could be actuated other than as described for example by a hand operated flush mechanism. Cable actuation need not be used. Conversely, the foot pedal and cable actuation arrangement of the invention could be used with another type of valve. The water valve and bowl refill systems could be used in other forms of toilet.

It should also be noted that, while the preferred embodiment described above relates to a permanently installed flush toilet designed to be coupled to an external water supply, some features could be used in a portable toilet. Primarily, this would apply to the foot pedal and cable actuation feature.

I claim:

1. A flush toilet comprising:

a toilet bowl having a downwardly opening waste outlet at a lower end thereof surrounded by an annular sealing surface;

a housing for supporting said bowl above a floor surface, said housing defining an internal space below said bowl outlet for receiving waste from the bowl, and having a bottom wall that includes a waste disposal outlet from said space for connection to external waste disposal means;

a valve member adapted to co-operate with said annular sealing surface surrounding the bowl outlet, for closing said outlet;

means pivotally supporting said valve member for movement between a closed position which the valve member co-operates with said sealing surface and closes said bowl outlet, and an open position in which the valve member is disposed laterally of and clear of said bowl outlet, said pivotal support means including two unequal length links pivotally supporting the valve member, said links being spaced in the direction of movement of the valve member between said open and closed positions and constraining the valve member to swing away from said sealing surface while moving laterally towards said open position when the bowl outlet is to be opened;

actuation means accessible from externally of the housing for moving the valve member between its closed and open positions; and, flush means operable to deliver flushing liquid into the bowl at appropriate times.

2. A toilet as claimed in claim 1, wherein said actuation means comprise means operable from externally of the toilet for moving the valve member from its closed position to its open position and return springs acting on said links and operable to bias the valve member towards its closed position.

3. A toilet as claimed in claim 1, wherein said valve member comprises a carrier member pivotally coupled to said links and a valve plate coupled to said carrier member so as to permit limited floating movement of the plate with respect to the carrier member for ensuring full seating of the plate on said sealing surface in the closed position of the valve member.

4. A toilet as claimed in claim 2, wherein each said link is one of a pair of links, the links in each pair being coupled to respectively opposite sides of the valve member and wherein said actuation means includes a generally U-shaped yoke pivotally coupled adjacent outer ends thereof to two of said links at opposite sides of the valve member, a foot pedal operable from externally of the toilet, and cable means connecting said foot pedal and yoke so that depression of the foot pedal causes the yoke to displace the valve member from its closed position to its open position.

5. A toilet as claimed in claim 1, wherein said flush means includes a water inlet valve for coupling to an external water supply and wherein said actuation means includes a foot pedal accessible from externally of the toilet and movable between a normal elevated position to which the pedal is biassed and a depressed operating position, means connecting the foot pedal with said valve member for moving the valve member between its closed and open positions, said connecting means including a first cable displaceable in response to depression of the foot pedal to move the valve member from its closed position to its open position, a second cable connected between said foot pedal and said flush water inlet valve and arranged to open the valve in response to depression of the foot pedal, first return spring means operable to return the valve member to its closed position upon release of the foot pedal and second return spring means acting on said water inlet valve and adapted to return the water inlet valve to its closed position on release of said pedal.

6. A toilet as claimed in claim 5, wherein said first and second cables are coupled to the foot pedal so that said second cable opens the water inlet valve before the first cable begins to move the valve member from its closed position to its open position, and permits the water inlet valve to close only after the valve member has returned to its closed position.

7. A toilet as claimed in claim 5, wherein said foot pedal is arranged in said depressed operating position to abut a floor surface on which the toilet is supported so that depression beyond said position and hence possible overstraining of the components actuated by the actuation means is positively prevented.

8. A toilet as claimed in claim 5, wherein said flush water inlet valve includes a valve body disposed on a support surface of said toilet housing and having an internally screw-threaded water inlet passageway opening into a lower face of the body, a generally tubular coupling member extending through an opening in said surface and threaded at an upper end portion thereof into said water inlet passageway of the valve body, said coupling member being adapted to clamp the valve body to the housing upon tightening of the coupling member into said internally screw-threaded water inlet passageway, the coupling member comprising the sole attachment means securing the valve member to the toilet housing.

9. A toilet as claimed in claim 8, wherein said housing includes an upper housing part and a lower housing part, the upper housing part including said toilet bowl and the lower housing part supporting the upper housing part with the bowl disposed above a support surface, said upper housing part defining a compartment for receiving said water inlet valve and including said support surface for the valve body, said coupling member extending through openings in both housing parts and said lower housing part being shaped to define a recess for providing access to said coupling member from externally of the toilet and permitting the valve member to be released from the toilet by unscrewing said coupling member.

10. A toilet as claimed in claim 8, wherein said water inlet valve is a diaphragm valve including a valve chamber into which said water inlet passageway opens at a valve seat, a diaphragm extending across said chamber and movable between a closed position in which it co-operates with said seat for closing said water inlet passageway, and an open position clear of said seat, actuation means operable to move the diaphragm into contact with said seat and a water outlet passageway communicating with said valve chamber for receiving water from the chamber when the diaphragm is in its open position, and wherein said seat is defined by a replaceable insert screw-threaded into said water inlet passageway, the valve being adapted to be disassembled to permit replacement of said seat.

11. A toilet as claimed in claim 10, wherein said water outlet passageway communicates with an outlet from the valve and wherein the flush means includes nozzle means in an upper region of the bowl through which flush water is delivered to the bowl, means connecting the nozzle means with the outlet of the flush water inlet valve and including a reservoir located at least substantially above the level of the nozzle means for retaining a body of flush water after closure of the inlet valve, the inlet valve including vacuum breaker means arranged to open in response to closure of the valve and admit air to said reservoir, permitting water in the reservoir to drain through said nozzle.

12. A toilet as claimed in claim 11, wherein said nozzle means includes a main outlet through which a major portion of flush water is delivered to the bowl and a secondary outlet through which a minor portion of said flush water can flow, and wherein the flush means further includes a pipe having an inlet end coupled to said secondary outlet of the nozzle and an outlet end positioned to deliver flush water across an upper surface of said valve member for flushing said surface when the valve member is in its said open position.

13. A flush toilet comprising:

a toilet bowl having a downwardly opening waste outlet at a lower end thereof surrounded by an annular sealing surface;

means for supporting said bowl above a floor surface;

flush means operable to deliver flushing water into the bowl at appropriate times and including a water inlet valve for coupling to an external water supply;

a valve member adapted to co-operate with said annular sealing surface surrounding the bowl outlet, for closing said outlet in a closed position of the valve member;

means supporting said valve member for movement between said closed position, and an open position clear of said bowl outlet; and, actuation means including a foot pedal accessible from externally of the toilet and movable between a normal elevated position to which the pedal is biassed and a depressed operating position, means connecting the foot pedal with said valve member for moving the valve member between its closed and open positions, said connecting means including a first cable displaceable in response to depression of the foot pedal to move the valve member from its closed position to its open position, a second cable connected between said foot pedal and said flush water inlet valve and arranged to open the valve in repsonse to depression of the foot pedal, and means effective on release of the foot pedal to return the valve member to its closed position and to close the water inlet valve; the foot pedal being arranged in said depressed operating position to abut a floor surface on which the toilet is supported so that depression beyond said position and hence possible overstraining of the components actuated by said actuation means is positively prevented.

14. A flush toilet comprising:

a toilet bowl having a downwardly opening waste outlet at a lower end thereof surrounded by an annular sealing surface;

means for supporting said bowl above a floor surface;

a valve member adapted to co-operate with said annular sealing surface surrounding the bowl outlet, for closing said outlet in a closed position of the valve member;

means pivotally supporting said valve member for movement between said closed position, and an open position clear of the bowl outlet;

flush means operable to deliver flushing water into the bowl at appropriate times, said flush means including a water inlet valve having an inlet for coupling to an external water supply, and an outlet, nozzle means in an upper region of the bowl through which flush water is delivered to the bowl, a tube extending around an upper portion of the toilet bowl and connecting said nozzle means with said outlet of the flush water inlet valve, said tube defining an elongated reservoir for retaining a body of flush water after closure of said inlet valve, said inlet valve including vacuum breaker means arranged to open in response to closure of the valve and admit air to said pipe, permitting water in the pipe to drain through said nozzle and refill the bowl; and actuation means accessible from externally of the housing for operating said water inlet valve and moving said valve member between its closed and open positions, said actuation means being arranged so that said valve member is closed during draining of the reservoir to permit refilling of the bowl from said reservoir with a residual amount of flush water.

15. A flush toilet comprising:

a toilet bowl having a downwardly opening waste outlet at a lower end thereof surrounded by an annular sealing surface;

a housing for supporting said bowl above a floor surface, said housing defining an internal space below said bowl outlet for receiving waste from the bowl, and having a bottom wall that includes a waste disposal outlet from said space for connection to external waste disposal means;

a valve member adapted to co-operate with said annular sealing surface surrounding the bowl outlet, for closing said outlet;

means supporting said valve member for movement between a closed position in which the valve member co-operates with said sealing surface and closes said bowl outlet, and an open position clear of the said bowl outlet;

actuation means accessible from externally of the housing for moving said valve member between its closed and open positions; and, flush means operable to deliver flushing water into the bowl at appropriate times, said flush means including a flush water inlet valve disposed on said upper housing part rearwardly of the toilet bowl and accessible from externally of the toilet, said valve including a valve body disposed on a support surface of said upper housing part and having an internally screw-threaded water inlet passageway opening into a lower face of said body, a generally tubular coupling member extending upwardly through an opening in said surface and threaded at an upper end portion thereof into said water inlet passageway of the valve body, said coupling member having a lower end portion adapted to be coupled to a water supply, and an external rib intermediate said end portions arranged to co-operate with the housing around said opening as the coupling member is screwed into said passageway in the valve body to clamp the body against said support surface, the housing being shaped to provide access to said coupling member below the valve body so that the valve can be released from the toilet by unscrewed said coupling member.

* * * * *